United States Patent [19]

Tsuchiya

[11] 4,184,318

[45] Jan. 22, 1980

[54] TIME INDICATING DEVICE FOR ELECTRONIC DIGITAL TYPE CAR CLOCKS

[75] Inventor: Tsuyoshi Tsuchiya, Tokyo, Japan

[73] Assignee: Copal Company Limited, Tokyo, Japan

[21] Appl. No.: 961,367

[22] Filed: Nov. 16, 1978

[30] Foreign Application Priority Data

Nov. 22, 1977 [JP] Japan ..... 52-140381

[51] Int. Cl.[2] ..... G04C 3/00

[52] U.S. Cl. ..... 58/23 BA; 58/23 AC; 58/50 R

[58] Field of Search ..... 58/23 R, 23 BA, 50 R, 58/23 A, 23 AC; 323/15; 363/26, 74

[56] References Cited

U.S. PATENT DOCUMENTS

| | | | |
|---|---|---|---|
| 3,701,249 | 10/1972 | Bergey et al. | 58/50 R |
| 3,747,323 | 7/1973 | Eckenrode | 58/50 R |
| 3,750,383 | 8/1973 | Kakizawa | 58/23 BA X |
| 3,760,582 | 9/1973 | Thiess et al. | 58/50 R |
| 3,818,484 | 6/1974 | Nakamura et al. | 58/23 BA X |
| 3,886,724 | 6/1975 | Kamiya | 58/23 BA |
| 3,946,550 | 3/1976 | Fujita | 58/50 R |
| 4,022,017 | 5/1977 | Aoki et al. | 58/50 R X |

*Primary Examiner*—Ulysses Weldon

*Attorney, Agent, or Firm*—Cushman, Darby & Cushman

[57] ABSTRACT

A time indicating device for electronic digital type car clocks utilizing a battery of an automobile as a current source and provided with a time counting part and a time indicating part, wherein, in order to reduce the power consumption, the time indicating part is driven by a pulse obtained by reducing the voltage of an output from an oscillating circuit in the time counting part or an independent oscillating circuit through a transformer.

1 Claim, 10 Drawing Figures

TIME INDICATING DEVICE FOR ELECTRONIC DIGITAL TYPE CAR CLOCKS

BACKGROUND OF THE INVENTION (a) Field of the Invention

This invention relates to car clocks and more particularly to improvements in an electronic digital type car clock utilizing a battery of an automobile as a current source and provided with a time counting part and a time indicating part.

(b) Description of the Prior Art

In the arrangement of a conventional car clock, as shown in FIG. 1, the voltage of a battery 1 of an automobile is normally fed through a constant voltage circuit 2 to a time counting part consisting of an oscillating circuit 3 as a time reference signal source, a counting circuit 4 and a decoder 5 and the voltage is fed to a time indicating part 6 through a resistor 8 by a switch 7 to be on as interlocked with the operation, for example, only when the engine key is rotated to the ON-position so that the power consumption may be reduced by avoiding the continuous lighting of the time indicating part 6 high in the power consumption.

However, in such conventional circuit, the resistor 8 is used to control the voltage when a fluorescent discharge tube is used for the indicating element of the time indicating part 6 and to control the current when a luminous diode is used for the indicating element and as a result, a comparatively large electric power will be wasted by this resistor 8.

SUMMARY OF THE INVENTION

A primary object of the present invention is to provide an electronic digital type car clock very low in the power consumption.

According to the present invention, this object is attained by driving a time indicating part with a pulse obtained by reducing through a transformer the voltage of an output from an oscillating circuit in a time counting part or an independent oscillating circuit.

Another object of the present invention is to provide a time indicating device for electronic digital type car clocks wherein the brightness of the time indicating part can be varied by changing over a switch.

A further object of the present invention is to provide a time indicating device for electronic digital type car clocks wherein the brightness of the time indicating part can be automatically varied in response to the surrounding brightness.

These and other objects of the present invention will become more apparent during the course of the following detailed description and appended claims.

DESCRIPTION OF THE PREFERRED EMBODIMENTS

Figure 1:
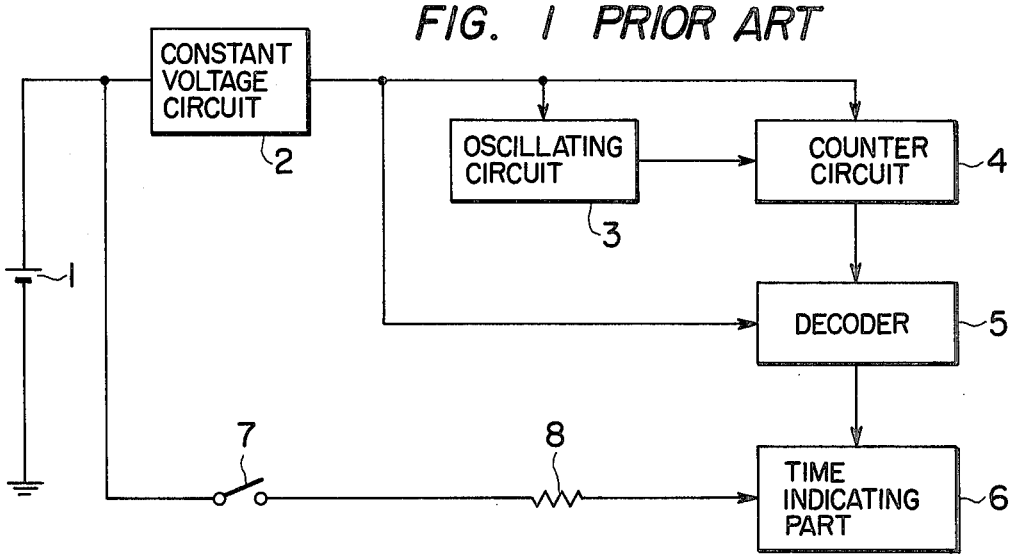
FIG. 1 PRIOR ART
FIG. 1 is a block diagram of a basic circuit of a conventional electronic digital type car clock.
Figure 2:
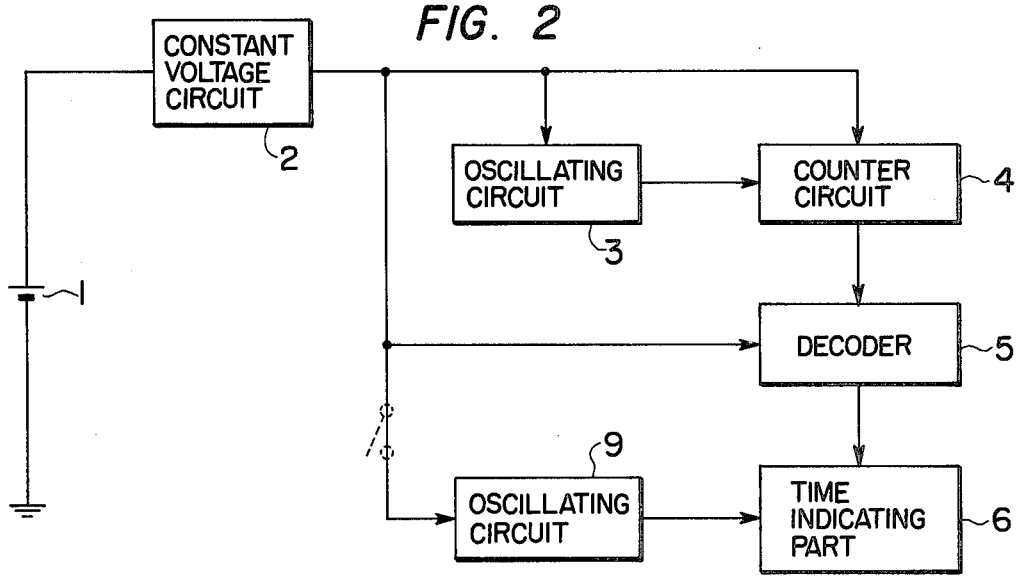
FIG. 2 is a block diagram showing an embodiment of an electronic digital type car clock according to the present invention.
Figure 3:
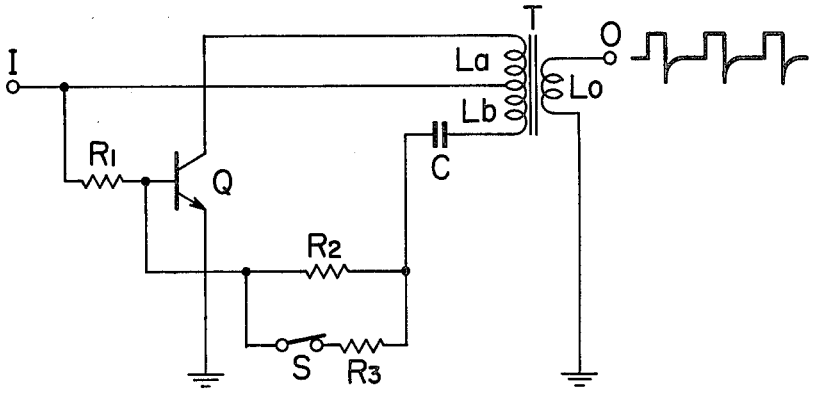
FIG. 3 is a wiring diagram showing a concrete embodiment of an oscillating circuit 9 shown in FIG. 2.

First of all, FIG. 2 shows in a block circuit a device wherein a voltage to a time indicating part 6 is fed through an oscillating circuit 9 provided with a voltage reducing transformer and separate from an oscillating circuit 3 in a time counting part. The oscillating circuit 9 provided with the voltage reducing transformer shall be concretely explained with reference to FIG. 3. This oscillating circuit 9 is formed as a blocking oscillating circuit. Symbol Q indicates a transistor, C indicates a capacitor, $R_1$, $R_2$ and $R_3$ indicate resistors and S indicates a normally closed type switch to be opened, for example, as interlocked with an engine key when it is rotated to the ON-position. Symbol T indicates a voltage reducing transformer consisting of primary coils La and Lb and a secondary coil Lc. A voltage from a constant voltage circuit 2 is normally fed to an input end I of the oscillating circuit. In the initial state, as the transistor Q conducts, the capacitor C will be charged through the course of the primary coil Lb→capacitor C→parallel circuits of the resistors $R_2$ and $R_3$→base and emitter of the transistor Q, and the electric current will flow also to the primary coil La through the collector and emitter of the transistor Q. When the capacitor C is charged to a predetermined value, the transistor Q will be cut off and, at this time, the electric charge of the capacitor C will be discharged through the resistor $R_1$→parallel circuits of the resistors $R_2$ and $R_3$. When the potential between the terminals of the capacitor C reduces to a predetermined value, the transistor Q will again conduct to resume charging the capacitor C. With the oscillation by the above operation, such pulse voltage as is illustrated will be generated at the output end O of the secondary coil $L_0$ of the voltage reducing transformer T and will be fed to the time indicating part 6. Here the duty ratio of the oscillation determining the width of the pulse voltage can be properly set by properly selecting the values of the resistors $R_1$, $R_2$ and $R_3$. Therefore, when the switch S is opened as interlocked with the operation of the engine key, the charging resistor to the capacitor C will be only the resistor $R_2$, therefore the charging time will become long and the duty ratio will increase (the frequency will also vary but will appear as the variation of the duty ratio by taking the frequency variation into consideration as a result). As a result, the brightness of the time indicating part 6 will increase. If the resistor which is an element determining the duty ratio of the oscillation is replaced with a photoconductive element, the brightness of the time indicating part 6 will vary in response to the amount of light incident upon the photoconductive element. That is to say, that brightness will be proportional to the amount of the incident light if the resistor $R_1$ is replaced with the photoconductive element and will be inversely proportional to the amount of the incident light if the resistors $R_2$ and $R_3$ are replaced with the photoconductive elements.

Figure 4:
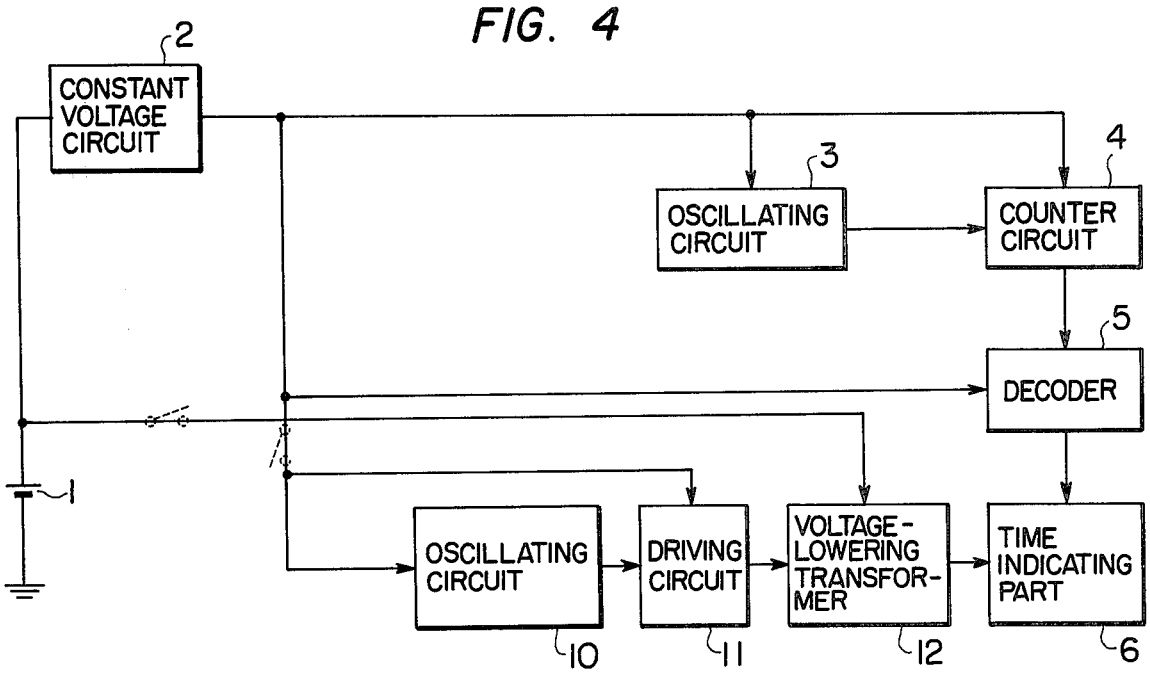
FIG. 4 is a block diagram showing another embodiment of an electronic digital type car clock according to the present invention.
Figure 5:
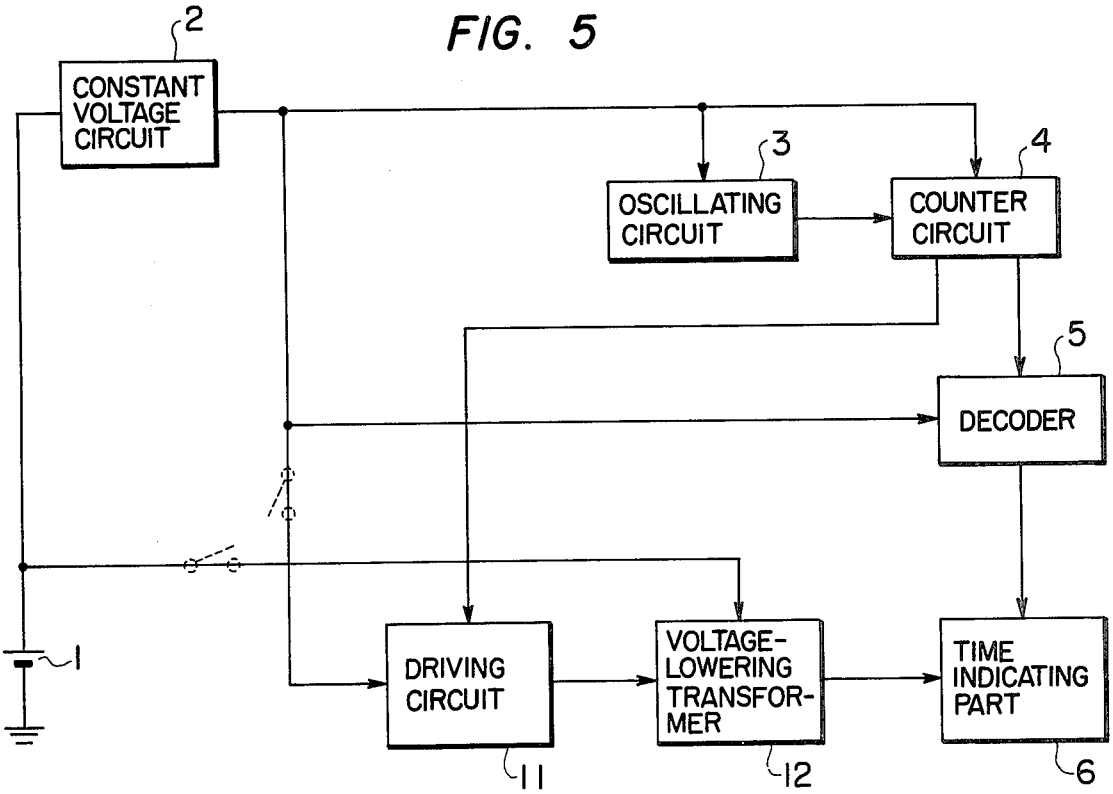
FIG. 5 is a block diagram showing a further embodiment of an electronic digital type car clock according to the present invention.

FIG. 4 is a block circuit showing a separately provided oscillating circuit 10, a voltage reducing transformer 12 and a driving circuit 11 for controlling said transformer 12 as separated. FIG. 5 is a block circuit wherein the signal obtained from the oscillating circuit 3 in the time counting part and the counting circuit 4 is given to the driving circuit 11.

Figure 6:
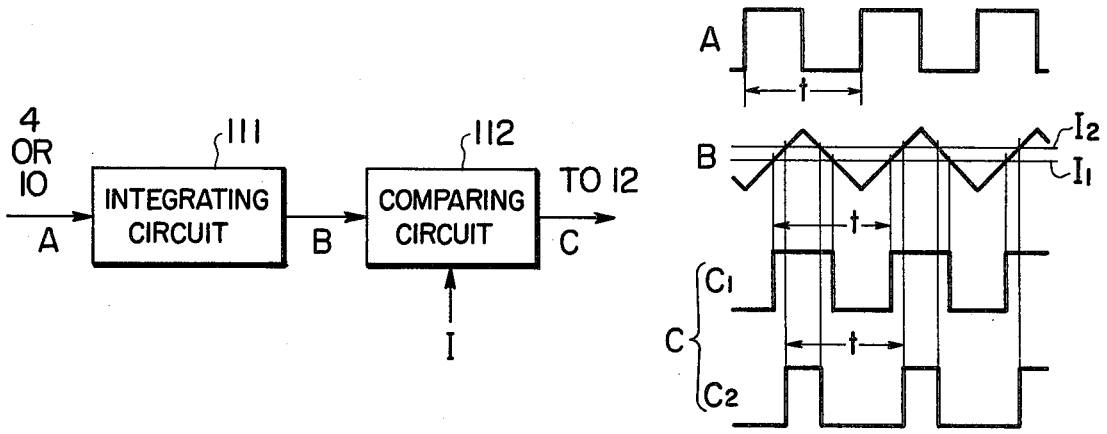
FIG. 6 is a view for explaining the arrangement and operation of a driving circuit 11 shown in FIGS. 4 and 5.
Figure 7A:
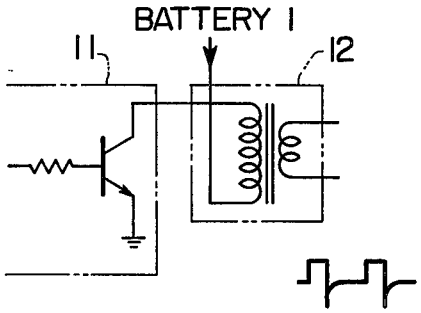
FIGS. 7A and 7B are wiring diagrams showing different examples of the combination of a driving circuit 11 and transformer 12.
Figure 7B:
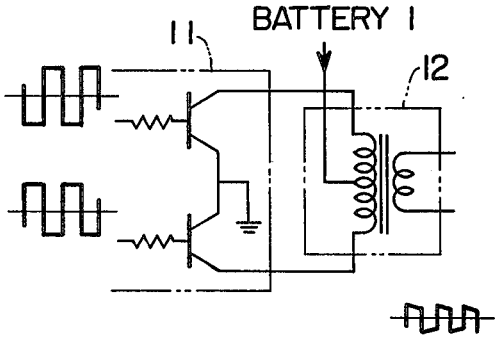
Figure 8A:
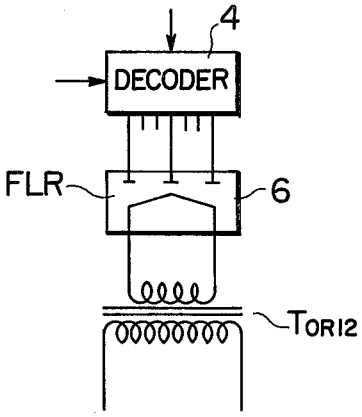
FIGS. 8A and 8B are explanatory views showing different examples of the combination of the transformer and time indicating part.
Figure 8B:
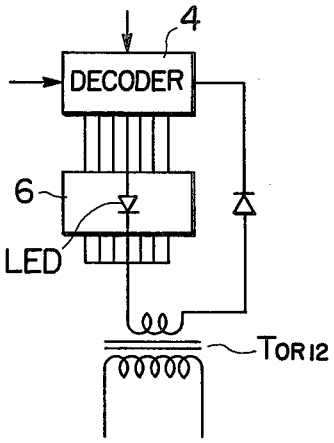

Now, the arrangement and operation of the driving circuit 11 shall be explained with reference to FIG. 6. The driving circuit 11 is formed of an integrating circuit 111 and comparing circuit 112. If a pulse is given from the oscillating circuit 10 or counting circuit 4 as an input A to the integrating circuit 111, an integrated voltage will appear in its output B and will be given to the comparing circuit 112. Such pulse voltages as $C_1$ and $C_2$ different in the duty ratio (in this case, the frequency will not vary) in response to the sizes of comparing inputs $I_1$ and $I_2$ will be generated in the output of the comparing circuit 112 and will be given to the voltage reducing transformer 12. In the same manner as in the preceding embodiment, the comparing input I to the comparing circuit 112 can be varied in response to the operation of the engine key and can be used as an information proportional or inversely proportional to the amount of light incident upon the photoconductive element. FIGS. 7A and 7B show the concrete examples of the connection between the output part of the driving circuit 11 and the voltage reducing transformer 12. Through the detailed explanation shall be omitted, FIG. 7A is of the case of a single amplifying circuit and FIG. 7B is of the case of a push-pull amplifying circuit. Further, the output of the oscillating circuit 9 provided with the voltage reducing transformer or of the voltage reducing transformer 12 is given to the time indicating part 6. However, as shown in FIG. 8A, in case a fluorescent discharge tube FLA is used for the indicating element, the output will be fed to its filaments and, as shown in FIG. 8B, in case a luminous diode LED is used for the indicating element, the output will be rectified and will be fed to both ends of the diode.

By the way, the above described switch S may be not only opened and closed as interlocked with the operation of the engine key but also may be controlled as interlocked with the rotation and stop of the engine and may be variously modified.

In the above description, the continuous lighting of the time indicating part 6 has been explained as a base. However, it is possible to avoid the continuous lighting. For that purpose, for example, a normally opened type switch (illustrated by the dotted line) operated and controlled the same as is described above may be inserted between the constant voltage circuit 2 and oscillating circuit 9 in FIG. 2, between the constant voltage circuit 2 and oscillating circuit 10 or driving circuit 11 or between the battery 1 and transformer 12 in FIG. 4 and further between the constant voltage circuit 2 and driving circuit 11 or between the battery 1 and transformer 12 in FIG. 5.

I claim:

1. In an electronic digital type clock using a battery of an automobile as a current source and including a time counting part and a time indicating part, a time indicating device comprising an oscillating circuit using said battery as a current source, an integrating circuit for integrating a signal from said time counting part to issue a triangular wave signal, a comparing circuit for comparing the output signal from said integrating circuit with a predetermined reference voltage to issue a rectangular wave signal, and a transformer for reducing the output from said comparing circuit, and being arranged so that the output from said transformer is fed to said time indicating part, and that the duty ratio of the output from said comparing circuit is varied by changing said reference voltage.

* * * * *